US005574333A

United States Patent [19]

Clerc

[11] Patent Number: 5,574,333

[45] Date of Patent: Nov. 12, 1996

[54] METHOD FOR MANUFACTURING A CATHODE FOR FLUORESCENT DISPLAY SCREENS OF THE MICROTIP-TYPE

[75] Inventor: Jean-Frédéric Clerc, Saint Egreve, France

[73] Assignee: Pixel International, Rousset, France

[21] Appl. No.: 390,087

[22] Filed: Feb. 17, 1995

[30] Foreign Application Priority Data

Feb. 22, 1991 [FR] France ..... 94 02291

[51] Int. Cl.[6] ..... H01J 9/02

[52] U.S. Cl. ..... 313/497; 425/24

[58] Field of Search ..... 445/24, 25; 313/495, 313/496, 497

[56] References Cited

U.S. PATENT DOCUMENTS 4,857,161 8/1989 Borel et al. ..... 313/309 X 5,259,799 11/1993 Doan et al. ..... 445/24

5,371,433 12/1994 Horne et al. ..... 313/495

5,408,161 4/1995 Kishino et al. ..... 313/495

*Primary Examiner*—Kenneth J. Ramsey

*Attorney, Agent, or Firm*—Plevy & Associates

[57] ABSTRACT

A method for manufacturing a fluorescent display screen cathode including microtips, comprises a supporting plate bearing cathode conductors in meshed columns, a resistive layer bearing microtips, an insulating layer and a grid conductive layer in rows. The method comprises the step of simultaneously etching the three upper grid layer, insulating layer and resistive layer according to a single perforated pattern defining both the grid rows and the access resistance to the microtips through the resistive layer.

9 Claims, 2 Drawing Sheets

METHOD FOR MANUFACTURING A CATHODE FOR FLUORESCENT DISPLAY SCREENS OF THE MICROTIP-TYPE

BACKGROUND OF THE INVENTION

1. Field of the Invention

The present invention relates to a method for manufacturing fluorescent display screen cathodes including microtips, as well as the product obtained with this method.

2. Discussion of the Related Art

The invention relates to the industrial field of flat display screens with matrix addressing, and more particularly to display screens using the microtip technology, i.e., screens having a vacuum tube formed by two thin glass plates, the back plate, or cathode plate, including a matrix array of field effect emitters which are deposited in accordance with thin-film techniques, and the front plate, or anode plate, being coated over its inner surface with a transparent conductive layer bearing phosphor elements.

In such screens, in front of each anode pixel, is formed a large number of microtips, constituting an emitting surface. This emitting surface is defined by the intersection of a row (grid conductor) and a column (cathode conductor) of the matrix.

The cathode of a conventional microtip screen is essentially formed by four layers which are successively deposited onto a glass or silicon substrate, and etched, namely: a conductive layer playing the role of cathode "column conductors"; a resistive layer, generally made of silicon, for limiting the value of the emission current; an insulating layer; and a second conductive layer constituting the grid "row conductors". After deposition of these layers, holes are etched in the grid and in the insulating layer and microtips are formed therein.

In conventional methods, at least four (and preferably five) masking and photoetching operations are necessary for the fabrication of the layers constituting the cathode, namely: etching the cathode columns, etching holes, etching the grid rows, etching the cathode contacts and, preferably, partially etching the resistive layer between the cathode columns to prevent leakages and column coupling.

In addition, the images formed by a microtip display screen are usually observed through the anode plate. So, it is the surface bearing the phosphor elements, opposite to the surface which receives the electrons, i.e., with the lowest brightness, which is seen.

SUMMARY OF THE INVENTION

An object of the present invention is to simplify the fabrication of the cathode of microtip fluorescent screens by reducing to three steps, instead of five, the number of masking operations.

Another object of the invention is to render the cathode transparent to improve the light efficiency while allowing the observation through the cathode of the phosphor material on the side hit by electrons.

These objects are achieved by simultaneously etching the three upper layers of the cathode (the grid, the insulating layer of the grid, and the resistive layer), in a single perforated pattern which defines both the grid rows and the access resistance to the microtips through the resistive layer, the column conductors being formed by thin metal lattice arrays.

The foregoing and other objects, features, aspects and advantages of the invention will become apparent from the following detailed description of the present invention when taken in conjunction with the accompanying drawings.

DETAILED DESCRIPTION

Figure 1:
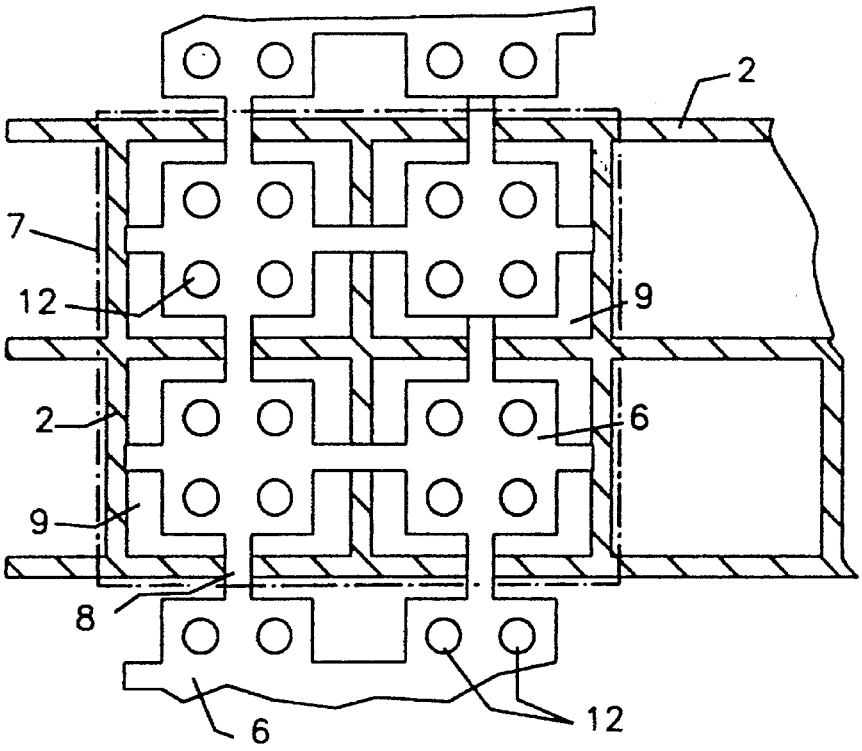
Fig. 1 schematically represents, as viewed from the top, an image point (pixel) defined as the intersection of a row and a column of the matrix array.
Figure 2:
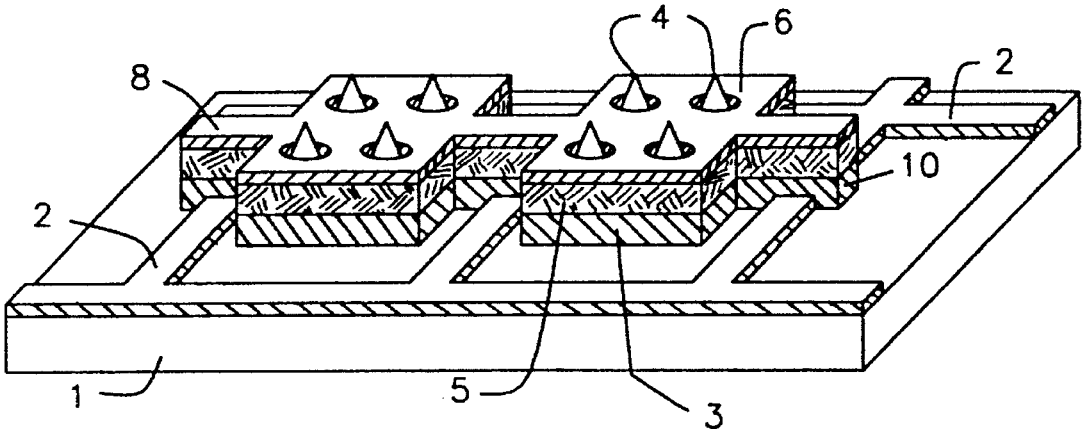
FIG. 2 is a perspective front view schematically illustrating a cathode structure according to the invention.
Figure 3:
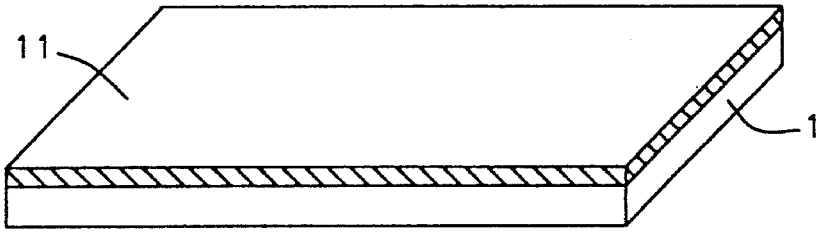
FIGS. 3–8 illustrate successive manufacturing steps of the cathode according to the invention.
Figure 4:
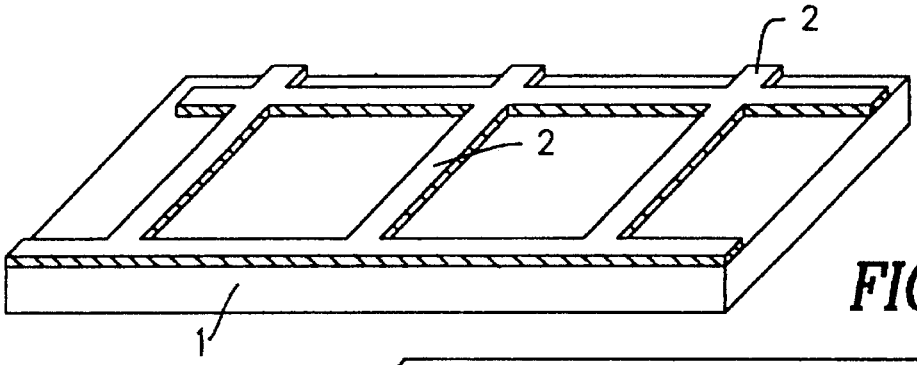

Figs. 1 and 2 represent the structure of the cathode of a microtip-type screen according to the present invention. This structure successively includes over a substrate constituted by a glass plate:

- column conductors 2 formed by perforated (meshed) strips of a layer of niobium, aluminum or other suitable conductor,
- a resistive layer 3 on which microtips 4 are formed,
- an insulating layer 5 (for example, $SiO_2$) which is the grid insulator,
- a conductive layer, made of niobium or other suitable material, which constitutes the grid 6 forming the row conductors.

The intersection of a row and a column defines a pixel 7 (refer to FIG. 1).

Figure 8:
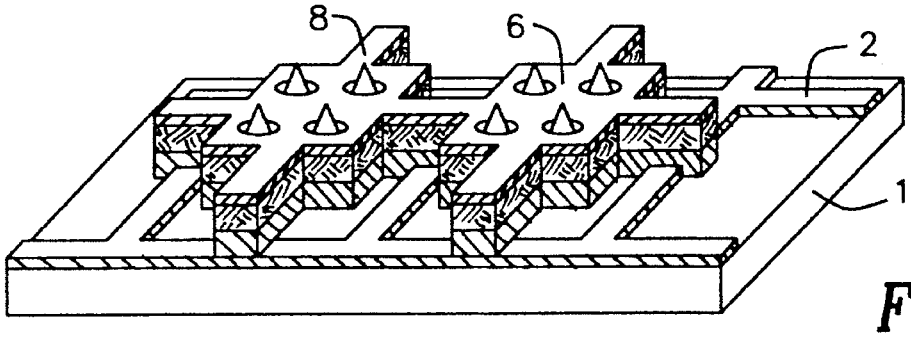

A column conductor 2 is formed by a perforated or meshed strip. Each grid row is made of square-shaped conductive elements 6 mutually connected by thin conductive bridges 8 (for the sake of simplification of FIG. 2, the longitudinal bridges only are represented; of course, two transverse bridges per square are also provided, as shown in FIG. 8). The microtips 4 are provided in the grid squares and not in the conductive bridges. Each pixel 7 is formed by a plurality of squares (four, in FIG. 1, but many more in practice). Each square bears several microtips (four in FIG. 1, but frequently sixteen in actual systems).

The respective sizes of the meshes of the column ductors 2 and of the squares forming gate 6 are selected so as to provide empty areas 9 between the squares and each column conductor. Thus, the phosphor elements of the anode can be observed through the cathode plate 1.

The electrical connection between the base of each microtip and the four sides of a cathode mesh is ensured by the current flow throughout the four resistive bars 10 and throughout the resistive square 3.

Therefore, the access resistance to the microtips is mainly controlled by the size of the bars as well as by the resistivity of the resistive layer.

This access resistance must be high enough for standardizing and limiting the emission current of the tips while introducing a voltage drop of only a few volts.

A screen has been fabricated according to the present invention. By way of example, the resistive layer was made of amorphous silicon having a resistance of 100 megohms per square. Four bars made it possible to access each square of 25-μm in side. The length/width ratio of the bars was 2. At a 80 -volt grid/anode polarization, the measured emission current was 500 mA per $dm^2$. Results of the same order of magnitude can be obtained with substantially equal values.

FIG. 2 also shows that the electrical continuity along a grid row from square to square is ensured by four conductive bridges 8 covering four insulating bars and four resistive bars 10. Since one mask only is used for the etching, the conductive bars ensuring the continuity of the grid rows and the resistive bars allowing the cathode current to feed the microtips have the same width and the same length.

Bars with identical shapes should allow a high current to flow through the grid rows and only a negligible leakage current to flow from one column to another. This leakage current is inversely proportional to the resistance of the resistive layer 3 whereas the bias current of the grids is inversely proportional to the resistance of the upper conductive layer. As mentioned above, a 100 megohm resistance per square is suitable to ensure the desired emission rate for a screen. In contrast, the resistance of the grid metal is very low: 1 ohm per square in the case of the device fabricated, with a 400 nm thick grid 6 made of niobium. The resistance ratio is therefore $10^8$. It has been experimentally demonstrated that, for a multiplexing ratio of several hundred of rows, a 60 -Hz image refreshing, a number of grey shades over 256 per color, the image obtained does not have any visible defect such as coupling of column by column or row by row. In addition, it is possible to replace niobium with a more highly conductive material (aluminum is 10 times more conductive).

Figure 5:
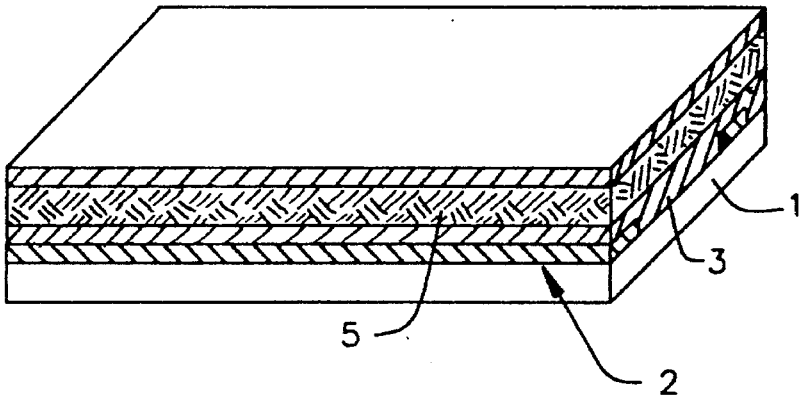
Figure 6:
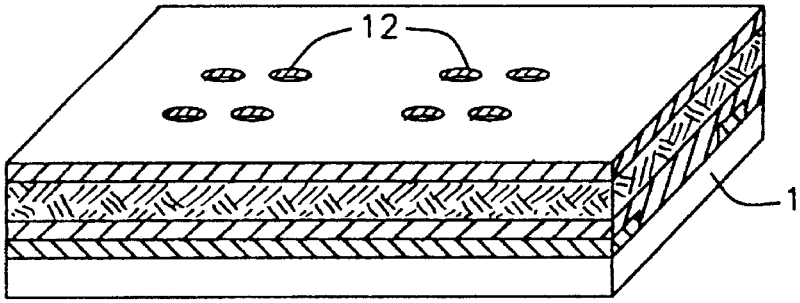
Figure 7:
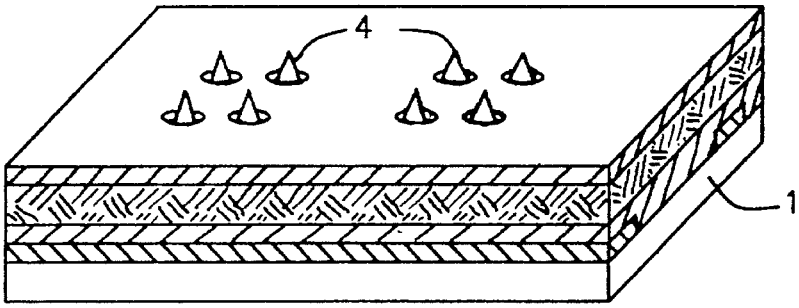

FIGS. 3–8 illustrate successive steps of a manufacturing method according to the present invention:

depositing a cathode metal layer 11 (refer to FIG. 3), etching meshed columns of cathode conductors 2 through a first mask (refer to FIG. 4), depositing a resistive layer 3, an insulating layer 5, and a grid layer 6 (refer to FIG. 5).

etching holes 12 of the microtips 4 with a second mask (refer to FIG. 6), depositing microtips (refer to FIG. 7), simultaneously etching grids 6, insulating layer 5 and resistive layer 3 according to apertured rows (refer to FIG. 8) with a third and last mask which also serves to define the contact areas of the rows and columns.

Thus, with three etching steps only, the same result is obtained as with the five conventional etching steps. Furthermore, the present invention provides a display screen that can be observed from the cathode.

Having thus described at least one illustrative embodiment of the invention, various alterations, modifications, and improvements will readily occur to those skilled in the art. Such alterations, modifications, and improvements are intended to be part of this disclosure, and are intended to be within the spirit and scope of the invention. Accordingly, the foregoing description is by way of example only and is not intended to be limiting. The invention is limited only as defined in the following claims and the equivalents thereto.

I claim:

1. A microtip fluorescent display screen having a cathode plate (1) including a supporting plate (1) bearing cathode conductors in meshed columns (2), a resistive layer (3) bearing microtips (4), an insulating layer (5) and a grid conductive layer (6) disposed in rows, wherein the grid layer (6), insulating layer (5) and resistive layer (3) are etched according to a single pattern forming predetermined elements so that empty areas (9) remain between said elements and the column meshes, thus allowing the observation of the phosphor elements of an anode plate through the cathode structure.

2. The microtip fluorescent display screen of claim 1, wherein the elements constituting the pattern of the grid (6), the insulating layer (5) and the resistive layer (3) are squares into which the microtips (4) are positioned, the squares being interconnected through thin conductive bridges (8) for the grid (6) and through resistive bars (10) to form lattices, each pixel (7) being formed by a plurality of lattices, and each square bearing several microtips (4).

3. The microtip fluorescent display screen of claim 2, wherein the grid (6) is made of niobium or aluminum having a thickness of approximately 400 nm, and wherein the resistive layer (3) is made of amorphous silicon having a resistance of approximately 100 megohms per square, four respective bars (10) with a length/width ratio of 2 allowing the access to each square lattice, the sides of the squares being approximately 25 micrometers.

4. A method for manufacturing a fluorescent display screen cathode including microtips, including a supporting plate (1) bearing cathode conductors in meshed columns (2), a resistive layer (3) bearing microtips (4), an insulating layer (5) and a grid conductive layer (6) in rows, comprising the step of simultaneously etching the three upper grig layer (6), insulating layer (5) and resistive layer (3) according to a single perforated pattern defining both the grid rows and the access resistance to the microtips (4) through said resistive layer.

5. The method of claim 4, including only three etching steps.

6. The method of claim 5, including the following steps:

depositing a cathode metal layer (11), etching meshed columns of conductors (2) in said metal layer through a first mask, depositing a resistive layer (3), an insulating layer (5), and a grid conductive layer (6), etching holes (12) for forming microtips (4) with a second mask, depositing microtips (4), simultaneously etching the grid layer (6), the insulating layer (5) and the resistive layer (3) in perforated rows with a third and last mask which also serves to define the contact areas of the rows and columns.

7. The method of claim 4, wherein the pattern or the grid conductive layer (6), insulating layer (5) and resistive layer (3) is formed by squares mutually interconnected by thin bridges, each pixel (7) being constituted by a plurality of squares.

8. The method of claim 7, wherein the path of the current flowing through the resistive layer (3), from the sides of a mesh of a column conductor (2) to the base of a microtip (4) is defined by four resistive bars (10) surrounding each square and formed simultaneously as conductive bridges (8) of the grid (6).

9. The method of claim 7, wherein the respective sizes of the meshes of the column conductors (2) and of the grid squares are selected so that empty areas (9) remain between said squares and said meshes allowing the observation through the structure of the cathode of the phosphor elements formed on an anode plate.

* * * * *